US007447471B2

(12) United States Patent
Landa et al.

(10) Patent No.: US 7,447,471 B2
(45) Date of Patent: Nov. 4, 2008

(54) INK HEATING ON BLANKET BY CONTACT OF A ROTATING HOT SURFACE

(75) Inventors: Benzion Landa, Nes Ziona (IL); Ishajau Lior, Rehovot (IL); Itzhak Ashkenazi, Kfar Gibton (IL); Avner Schneider, Nes Ziona (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 156 days.

(21) Appl. No.: 10/575,767

(22) PCT Filed: Oct. 23, 2003

(86) PCT No.: PCT/IL03/00865

§ 371 (c)(1),
(2), (4) Date: Apr. 12, 2006

(87) PCT Pub. No.: WO2005/040940

PCT Pub. Date: May 6, 2005

(65) Prior Publication Data

US 2007/0134030 A1 Jun. 14, 2007

(51) Int. Cl.
*G03G 15/16* (2006.01)

(52) U.S. Cl. ..... 399/307; 399/249; 399/308; 430/124.11

(58) Field of Classification Search ..... 399/307, 399/302, 308, 249, 251; 430/124.11, 125.32
See application file for complete search history.

(56) References Cited

U.S. PATENT DOCUMENTS

| | | | | |
|---|---|---|---|---|
| 4,974,027 | A | 11/1990 | Landa et al. | |
| 5,933,694 | A * | 8/1999 | Yamashita et al. | 399/307 X |
| 5,987,284 | A * | 11/1999 | Lewis | 399/249 |
| 6,002,907 | A * | 12/1999 | Berkes | 399/307 |
| 6,078,776 | A * | 6/2000 | Okamoto et al. | 399/308 |
| 6,356,728 | B1 * | 3/2002 | Watanabe | 399/251 X |
| 7,031,648 | B2 * | 4/2006 | Takashi et al. | 399/307 |
| 2002/0106220 | A1 | 8/2002 | Nakashima et al. | |
| 2002/0159801 | A1 * | 10/2002 | Nakashima et al. | 399/307 |
| 2002/0176723 | A1 | 11/2002 | Fletcher et al. | |

FOREIGN PATENT DOCUMENTS

| | | | |
|---|---|---|---|
| EP | 0935173 | A1 | 11/1999 |
| JP | 2002-287530 | A * | 10/2002 |

OTHER PUBLICATIONS

International Preliminary Examining Authority Written Opinion.

* cited by examiner

*Primary Examiner*—Sophia S Chen

(57) ABSTRACT

A method of heating toner of an image on a moving surface of an intermediate transfer member in order to transfer the image to a printing medium of a printing system includes providing a toner image on an intermediate transfer member, and placing a surface of a heated member in contact with the toner image on the intermediate transfer member prior to transferring the toner image to a further surface from the intermediate transfer member. Heating of the toner image by the contacting heated member is in addition to heating by a heater internal to the intermediate transfer member.

19 Claims, 2 Drawing Sheets

INK HEATING ON BLANKET BY CONTACT OF A ROTATING HOT SURFACE

RELATED APPLICATIONS

This patent application claims priority to PCT Appln. No. PCT/IL2003/000865, having PCT Publication No. WO2005/040940, and filing date of 23 Oct. 2003, commonly assigned herewith, and hereby incorporated by reference.

FIELD OF THE INVENTION

The present invention relates to the process of electrophotographic printing and more particularly to electrophotographic printing from an intermediate transfer member.

BACKGROUND OF THE INVENTION

In electrophotographic printing a common method of practice comprises the following process:

A latent electrostatic image is prepared on a photoconductive drum. Liquid toner (i.e., toner particles dispersed in a carrier liquid) is brought into contact with the photoconductive drum and toner particles adhere to charged (or discharged) portions thereof representing the latent image. Much of the carrier liquid is then generally removed from the image and background areas of the drum, by squeegeeing with a roller or other means as known in the art. The latent image is transferred by intimate contact to a drum (or other surface) that is comprised from material suited for high quality transfer of the image to a print media. The drum is referred to herein as an intermediate transfer member (ITM), since it serves to transfer the image from the photoconductive drum to the print media (e.g. paper or plastic).

An example of a system that operates utilizing this general methodology, is described in U.S. Pat. No. 5,410,392 the disclosure of which is incorporated herein by reference. High speed printers, such as the H-P 3000 sold by Hewlett Packard operate under this general methodology.

Optionally, in the process described above, a latent image can be repetitively formed on the photoconductive drum using different colored toners to form a multicolor image (for example, using cyan, yellow, magenta and black). In some processes the accumulation of the multicolor image is performed on the ITM and all of the color separations are transferred together to a final substrate. In some processes, each color is transferred separately to the final substrate, via the ITM.

Typically the ITM is heated in order to improve the quality of the image transferred to the print media. Heating of the ITM decreases the viscosity of the toner and ensures better transfer to the print media. In current practice, the toner solvates at least some of the remaining carrier liquid and becomes plasticized. The heat of the ITM typically causes the toner to coalesce and/or to form a film. This film is then transferred to the final substrate.

One method of heating the ITM, known in the art, is by installing a heater inside the ITM and heating the entire body of the ITM. This method requires generating enough heat to reach a desired temperature on the surface of the ITM in order to affect the toner. One drawback of this method is that heating continuously or repetitively to high temperatures has a detrimental effect on the resilience of the ITM and on the life of the coating of the ITM's surface. Furthermore, since the ITM is heated over its entire surface, heat loss and thus power requirements are high. Finally, heating an intermediate transfer roller from within is not efficient.

An alternative method that has been proposed for heating the toner on the ITM, is by radiating the surface of the ITM. However since many color inks have very low absorption rates this method requires the heating of the ITM surface coating, which will pass on the heat to the toner. In order for the surface coating to absorb the radiation and affect the toner, it is required that it be coated with a dark color (e.g. black). Additionally, radiating requires radiating at high temperatures due to heat loss. Further additionally, external heating has the risk of causing a fire in case of a paper jam in the area being radiated, due to the flammability of the carrier liquid.

As a practical matter, modern liquid toner printing uses an internally heated drum, covered by an intermediate transfer blanket.

One method of avoiding heating of an intermediate transfer member is to provide direct transfer of the image from the photoreceptor to the final substrate. To allow for film forming prior to transfer, the image is heated on the photoreceptor. However, since the photoreceptor itself is usually heat sensitive, the heating must be limited.

U.S. Pat. No. 5,426,491, the disclosure of which is incorporated by reference, describes a method by which the image on the photoreceptor is subject to heating, which causes the particle in the liquid toner to coalesce and form a film. However, heating using light is inefficient since in general only a minor portion of the energy is absorbed by the toner. Also, heating lamps are hot and pose a safety hazard in the presence of carrier liquid.

EP publication 0 549 867 A2, the disclosure of which is incorporated by reference, describes a method in which a heated electrified roller is applied to the wet image on the photoreceptor. The pressure and electrification of the roller cause liquid to be removed from the image and the image to be compressed and to become unitary. The heat causes the image to become tacky, so that it will adhere to the substrate. This publication makes clear that the method is meant as a way of avoiding the use of an ITM, which is considered to be undesirable by the inventors.

SUMMARY OF THE INVENTION

An aspect of some embodiments of the invention, relates to a method of heating the toner of an image on an intermediate transfer member (ITM) by applying the heat directly to the toner. In an exemplary embodiment of the invention, a heating roller is coupled to the ITM. The heating roller transfers heat to the toner by direct contact with the toner particles on the surface of the ITM.

In some embodiments of the invention, a heated belt is used instead of a heated roller in order to provide a greater contact area between the heat source and the ITM.

In some embodiments of the invention, less energy is required than in prior methods since the heat is applied directly to the toner just before its contact with the print media.

In an exemplary embodiment of the invention, the direct heating is applied in addition to other sources of heat, supplied by methods known in the art, for example heating internal to the ITM or radiating the surface coating of the ITM. Optionally, the additional sources of heat are applied with a lower level of heating (i.e., the temperature of the ITM is lower than in the prior art) since direct toner heating provides a portion of the heating of the image.

In contrast with prior art ITM heating methods, the hotter part of the image is the side that is made to adhere to the substrate. This improves transfer, since this allows for increased cohesiveness of the image for the same tackiness of the image to substrate. This increased cohesiveness improves transfer and allows the film to transfer as a whole, without breaking up.

Furthermore, as the speed of the printer increases, the required temperature of the ITM for good transfer increases. In some cases, it is necessary to heat the ITM to 180° C. At these high temperatures, the life of the blanket is severely reduced.

In an embodiment of the invention, in addition to heat and pressure, the roller is electrified with respect to the intermediate transfer member. This electrification has a polarity that presses the toner particles to the intermediate transfer member. Thus electrifying the roller has the dual effect of compacting the image and urging the toner from the roller. In general, the toner has a tendency to stick to the hot roller.

There is thus provided, in accordance with an embodiment of the invention, a method of heating toner of an image on a moving surface of an intermediate transfer member in order to transfer the image to a printing medium of a printing system comprising:

providing a toner image on an intermediate transfer member; and placing a surface of a heated member in contact with said image on said intermediate transfer member, prior to transferring the toner image to a further surface from the intermediate transfer member.

In an embodiment of the invention, the method includes moving the surface of the heated member together with the moving surface of the intermediate transfer member, so that the heated member surface comes into contact with the intermediate transfer member surface.

Optionally, the method includes removing the surface of the heated member from contact with the intermediate transfer member.

Optionally, the heated member comprises a cylindrical drum contacting said intermediate transfer member, arranged such that portions of the intermediate transfer member surface contact portions of the heated surface and then are separated therefrom by motion of the intermediate transfer member and rotation of the heated member.

Optionally, the heated member comprises a belt contacting said intermediate transfer member, arranged such that portions of the intermediate transfer member surface contact portions of the heated surface and then are separated therefrom by motion of the intermediate transfer member and motion of the heated member.

Optionally, the method includes removing excess carrier liquid from the image prior to its transfer to the intermediate transfer member.

Optionally, heating of the image by the contacting heated member is in addition to heating by a heater, internal to said intermediate transfer member.

Optionally, the heated member supplies at least 50% or 70% of the heat for heating the toner of the image on said intermediate transfer member.

Optionally, the internal heater is a radiant heater that heats the intermediate transfer member by heat radiated and air conducted from the heater.

Optionally, the method includes transferring the heated image from the intermediate transfer member, wherein heating the toner image to a temperature suitable for transfer to a final substrate uses less than 50% of the energy necessary to heat said toner to said suitable temperature by a heater internal to the intermediate transfer member alone.

Optionally, the image is transferred from the intermediate transfer member, under pressure.

There is further provided, in accordance with an embodiment of the invention, a printing method comprising:

heating a toner image according to the method of the invention; and transferring the still hot toner image to a final substrate.

There is further provided, in accordance with an embodiment of the invention, a system for heating a toner image for printing on a print media comprising:

an intermediate transfer member, adapted to receive an image at a first position and to transfer the received image at a second position; and a heating member contacting said image and said intermediate transfer member as it passes between said first and second positions.

Optionally, the heating member is a heated rotating drum.

Optionally, the heating member is a heated moving belt.

Optionally, the system includes means for removing excess carrier liquid from the image prior to its transfer to the intermediate transfer member.

BRIEF DESCRIPTION OF THE DRAWINGS

Particular non-limiting embodiments of the invention will be described with reference to the following description of embodiments in conjunction with the figures. Identical structures, elements or parts which appear in more than one figure are generally labeled with a same or similar number in all the figures in which they appear, in which.

DETAILED DESCRIPTION OF EXEMPLARY EMBODIMENTS

Figure 1:
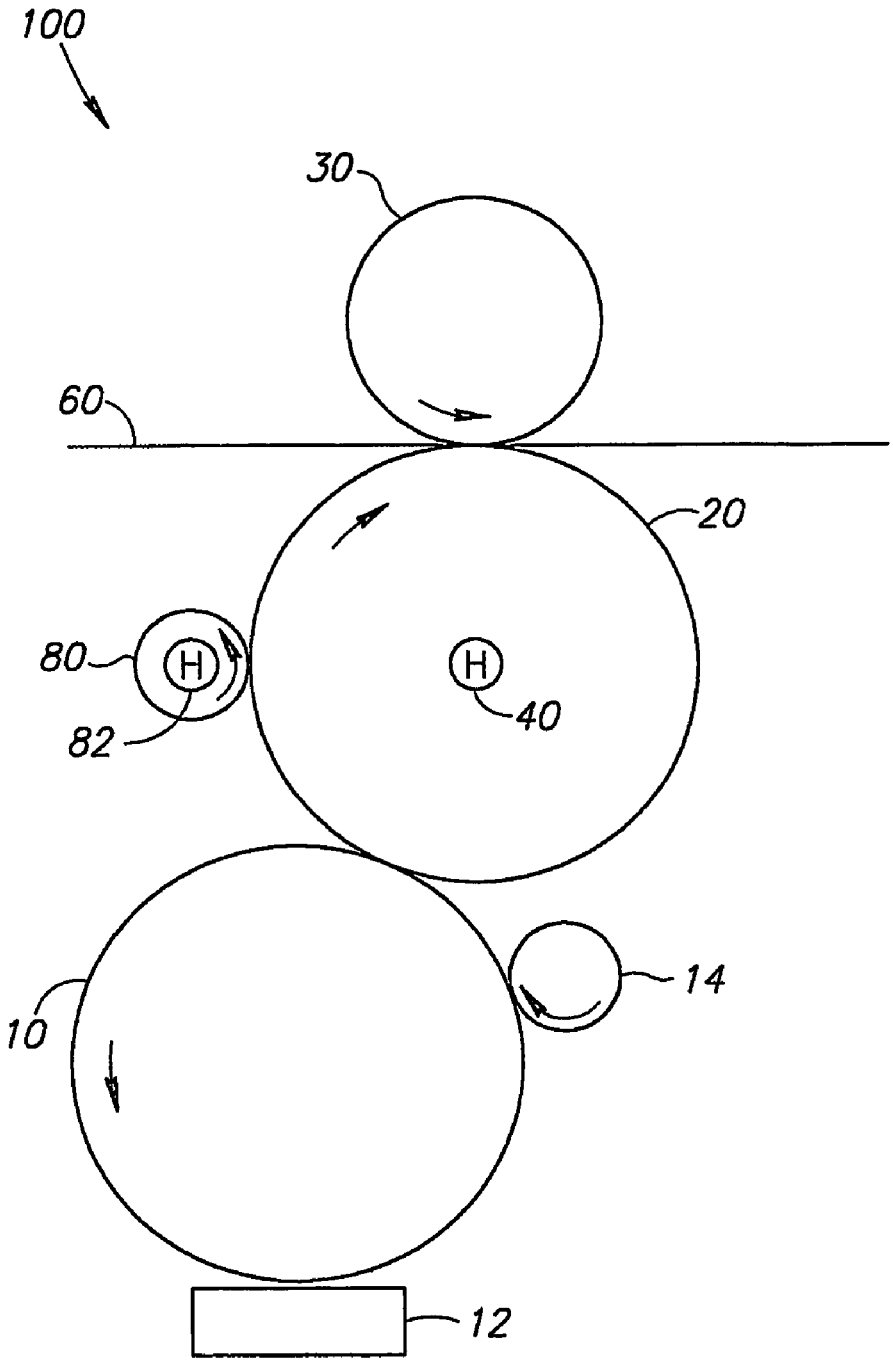
FIG. 1 is a schematic illustration of a printing system using an intermediate transfer member according to an exemplary embodiment of the invention.

FIG. 1 is a schematic illustration of a photoconductor based printing system 100 using an intermediate transfer member according to an exemplary embodiment of the invention. In FIG. 1 a photoconductor drum 10 is illustrated as operative for preparing a latent image for transfer to output. Details of the production of the image are substantially irrelevant to the present invention and the process is indicated generally by a block 12. A wide range of methods known in the art for the production of liquid toner images can be used. Optionally, an electrified squeegee roller 14, as known in the art, is provided to remove excess liquid from the image and to compress the image. Optionally, alternatively or additionally, other means for removing excess moisture are used, such as an air knife or other means known in the art.

In some embodiments of the invention, the latent image is not transferred directly to an output medium 60 (e.g. paper or plastic), but instead it is transferred to an intermediate transfer member (ITM) 20, for example in order to protect photoconductor drum 10 and/or to provide a more efficient, controllable process and to improve transfer. In some systems, individual color separations are transferred to the ITM and then to the final substrate. In other embodiments, multiple toner images are accumulated on the ITM, and transferred as a group to the final substrate.

ITM 20 is a drum (or a blanket on a drum) coated with materials suitable for receiving the toner from photoconductor drum 10 and transferring it to output medium 60, for example as described in U.S. Pat. Nos. 4,974,027; 5,335,054; 5,276,429; 5,815,782; 5,410,392; 5,592,269; 5,745,829;

6,551,716; 6,584,297; and PCT publication WO 97/07433, the disclosures of which is incorporated herein by reference.

In an exemplary embodiment of the invention, a heating roller 80 is coupled to ITM 20, such that it will rotate with ITM 20 while forming direct contact, in order to directly heat the toner image on the surface of ITM 20. Optionally, heating roller 80 is made from a metal and coated with a substance that is durable to heat, smooth and non-adhesive, for example silicone, condensation cured silicone, Teflon, HTV and RTV fluorosilicone or other fluoromaterials; blends of silicone and fluorosilicone, blends of silicone and polyurethane, for example in a range of 10/90 to 20/80, of silicone to polyurethane. Heater roller 80 preferably heats the toner without degrading the toner image. In an embodiment of the invention, the heater roller is coated with a material that is more replacing than the release coating of the ITM. Alternatively or additionally, the ITM is operated for a number of cycles. Operation of an ITM generally deteriorates the release properties of the ITM, so that the roller is more replacing than the ITM.

In an exemplary embodiment of the invention, heating roller 80 is heated to a temperature between 60-200° C. In some embodiments of the invention, the selected temperature of heating roller 80 is a function of the process speed and duration of contact. At a faster process speed contact between heating roller 80 and the toner particles on ITM 20 is shorter and a higher temperature is needed.

Optionally, heating roller 80 comprises an internal heating unit 82, as known in the art.

In preferred embodiments of the invention, contact with roller 80 performs one or more and preferably all of forming the toner articles into a film, removing additional liquid from the image and increasing the transferability of the toner to the substrate.

In an exemplary embodiment of the invention, as ITM 20 rotates, the heated toner image comes into contact with output medium 60, which is guided and pressed against ITM 20 by a transfer roller 30. The toner image on ITM 20 forms a sharp printout on output medium 60 as a result of its tacky state and from the pressure exerted by transfer roller 30. In some embodiments of the invention, transfer roller 30 is additionally electro-statically charged in order to cause the toner to be pulled toward the paper during contact. Alternatively or additionally, transfer roller 30 is heated in order to assure that the toner is exposed to sufficient heat. The substrate can be preheated, for example as described in U.S. Pat. No. 6,562,539, the disclosure of which is incorporated herein by reference. In this reference, the substrate is heated to a temperature that is below that of the ITM at the transfer point, but above room temperature. When used in conjunction with the present invention, the substrate is preferably heated to a temperature that is lower than the temperature of the image. However, it may be heated to a temperature that is above that of the relatively cool ITM.

In some embodiment of the invention output medium 60 is mounted on transfer roller 30, in order to form better alignment between the output medium 60 and the toner image on ITM 20.

Optionally, ITM 20 comprises an internal heating unit 40 used to maintain a given temperature level on the surface of ITM 20. This given temperature is lower, optionally 10, 20, 30 or more degrees lower than required for complete transfer of the image, without the presence of roller 80. In some embodiments the ITM temperature is only 40° C. which is 70-80° C. lower than necessary in the absence of heating roller 80. When the ITM temperature is low, the toner image does not harden as quickly, if, for example, a malfunction causes the printer to stop. In some embodiments of the invention, internal heating unit 40 supply less than 50%, 40% or 30% of the heat energy for heating the toner image on the surface of ITM 20. The rest of the heat is supplied by directly heating the toner image with heating roller 80. The roller may be as hot as 130° C. to 200° C., although lower temperatures can be used with good effect.

In some embodiments of the invention, the total amount of energy needed to heat the toner image to a desired temperature using heating roller 80 is less than 50%, 60% or 75% of the energy needed to heat the image using the methods from the prior art.

It should be noted that although heating roller 80 is applied to heat the image toner, some of the heat energy heats the surface of ITM 20 by contact between non printed areas and heating roller 80. However, since the image toner is heated by direct contact the heating efficiency is much greater than in the methods of the prior art. Also, the great bulk of the ITM, including the bulk of the ITM drum, is heated to only a minor degree by roller 80. The surface of the ITM, after transfer of the image to the substrate (and partly because of cooling by the substrate) is much lower than it would be in the absence of roller 80, so that the energy required to maintain this temperature is relatively low, as indicated above.

In an embodiment of the invention, in addition to heat and pressure, the roller is electrified with respect to the intermediate transfer member. This electrification has a polarity that presses the toner particles to the intermediate transfer member. Thus electrifying the roller has the dual effect of compacting the image and urging the toner from the roller. In general, the toner has a tendency to stick to the hot roller.

Figure 2:
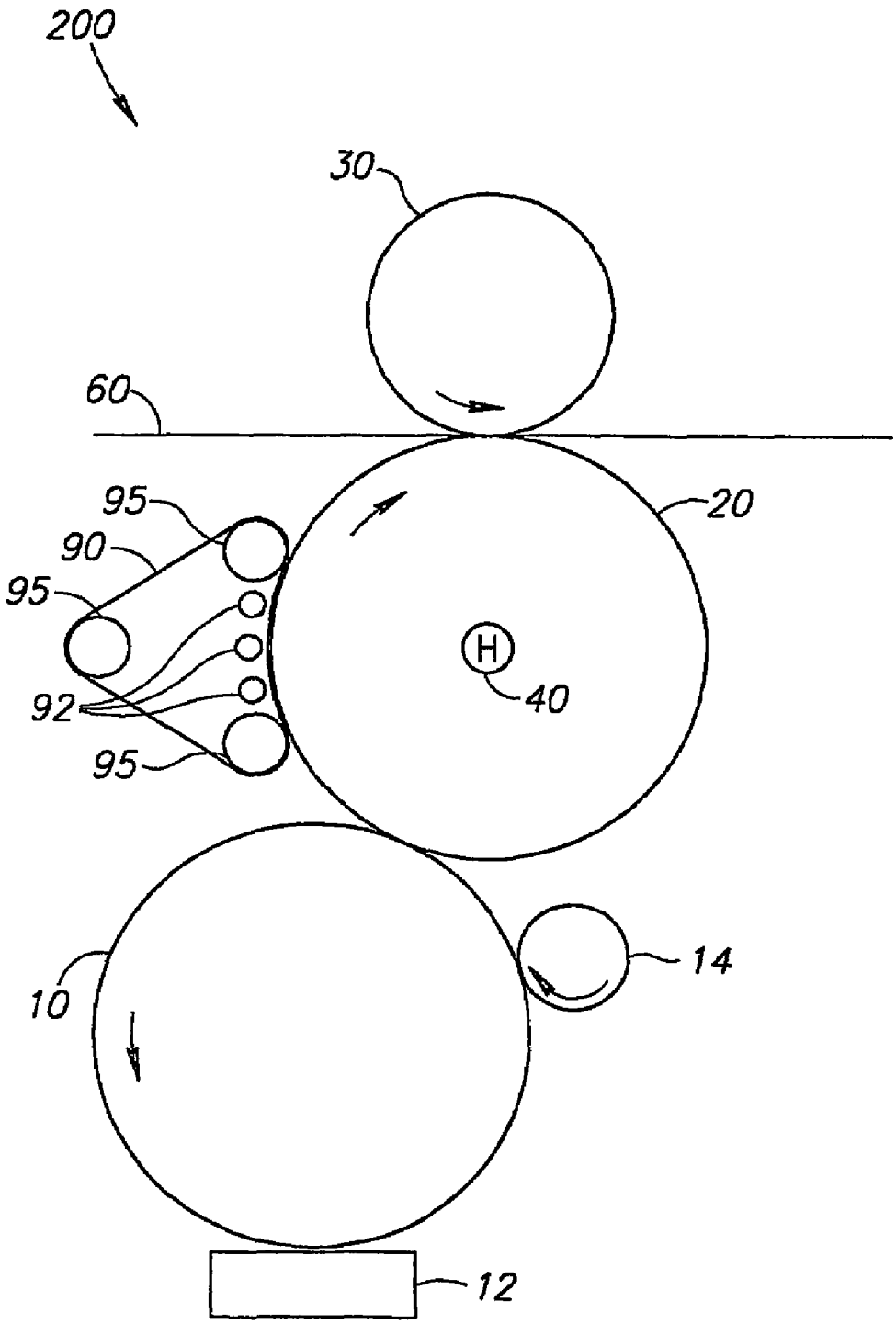
FIG. 2 is a schematic illustration of an alternative printing system using an intermediate transfer member according to an exemplary embodiment of the invention.

FIG. 2 is a schematic illustration of an alternative printing system 200 using an intermediate transfer member 20 according to an exemplary embodiment of the invention. In printing system 200, heating unit 80 is replaced by a belt 90. Belt 90 is optionally mounted on two or more wheels 95 (an embodiment with three wheels is shown), to allow coupled motion of belt 90 with ITM 20.

In some embodiments of the invention, heating belt 90 provides a larger area of contact between heating belt 90 and the image toner, since it is not limited to a single tangent point of contact such as with heating roller 80. Optionally, heating belt 90 is heated to a lower temperature than heating roller 80 since it is in longer contact with the toner image for transferring heat.

Alternatively to utilizing a belt, a relatively soft roller 80 is provided, so that a larger nip at its contact with photoconductor 20 is provided.

In some embodiments of the invention, heating belt 90 is heated by one or more heating units positioned in wheels 95. Alternatively or additionally, heating belt 90 is heated by one or more heating units 92 positioned in the void covered by heating belt 90 as shown in FIG. 2. Alternatively, the belt may be formed with an internal heater which heats all of its surface or selectively heats only the region of contact (optionally together with a portion prior to contact).

The present invention has been described using non-limiting detailed descriptions of embodiments thereof that are provided by way of example and are not intended to limit the scope of the invention. It should be understood that features and/or steps described with respect to one embodiment may be used with other embodiments and that not all embodiments of the invention have all of the features and/or steps shown in a particular figure or described with respect to one of the embodiments. Variations of embodiments described will occur to persons of the art.

It is noted that some of the above described embodiments may describe the best mode contemplated by the inventors and therefore include structure, acts or details of structures and acts that may not be essential to the invention and which are described as examples. For example, the invention is described with reference to particular types of toner. The invention is usable with other types of known toners. Furthermore, the invention is described in the context of using a "photoconductor" to form the image. However, the invention is not limited to electrophotography or to any particular method of forming the image.

Structure and acts described herein are replaceable by equivalents which perform the same function, even if the structure or acts are different, as known in the art. Therefore, the scope of the invention is limited only by the elements and limitations as used in the claims. When used in the following claims, the terms "comprise", "include", "have" and their conjugates mean "including but not limited to".

The invention claimed is:

1. A method of heating toner of an image on a moving surface of an intermediate transfer member in order to transfer the image to a printing medium of a printing system comprising:

providing a toner image on an intermediate transfer member; and placing a surface of a heated member in contact with said toner image on said intermediate transfer member, and heating the toner image by the heated member prior to transferring the toner image to a further surface from the intermediate transfer member, wherein heating of the toner image by the contacting heated member is in addition to heating by a heater, internal to said intermediate transfer member, wherein the heated member comprises a belt supported by at least two spaced wheels with a segment of the belt supported and extended between the spaced wheels providing surface contact with the intermediate transfer member.

2. A method according to claim 1 and including:

moving the surface of the heated member together with a surface of the intermediate transfer member, so that the surface of the heated member comes into contact with the surface of the intermediate transfer member.

3. A method according to claim 2 and including:

removing the surface of the heated member from contact with the intermediate transfer member.

4. A method according to claim 1 and including removing excess carrier liquid from the toner image prior to transfer of the toner image to the intermediate transfer member.

5. A method according to claim 1 wherein the internal heater is a radiant heater that heats the intermediate transfer member by heat radiated and air conducted from the heater.

6. A method according to claim 1 wherein the toner image is transferred from the intermediate transfer member, under pressure.

7. A method according to claim 1 wherein the belt of the heated member is heated by at least one heating unit positioned in at least one of the at least two spaced wheels.

8. A method according to claim 1 wherein the belt of the heated member is heated by at least one heating unit positioned in a void covered by the belt.

9. A system according to claim 8 wherein the at least one heating unit is positioned in the void covered by the belt adjacent a region of the belt providing surface contact with the intermediate transfer member.

10. A method according to claim 1 wherein the belt of the heated member is selectively heated in a region of the belt providing surface contact with the intermediate transfer member.

11. A method according to claim 1 wherein the belt of the heated member is supported by three triangularly-spaced wheels.

12. A method of heating toner of an image on a moving surface of an intermediate transfer member in order to transfer the image to a printing medium of a printing system comprising:

providing a toner image on an intermediate transfer member; and placing a surface of a heated member in contact with said image on said intermediate transfer member, prior to transferring the toner image to a further surface from the intermediate transfer member, wherein heating of the image by the contacting heated member is in addition to heating by a heater, internal to said intermediate transfer member, wherein said heated member supplies at least 50% of the heat for heating the toner of the image on said intermediate transfer member.

13. A method of heating toner of an image on a moving surface of an intermediate transfer member in order to transfer the image to a printing medium of a printing system comprising:

providing a toner image on an intermediate transfer member, and placing a surface of a heated member in contact with said image on said intermediate transfer member, prior to transferring the toner image to a further surface from the intermediate transfer member, wherein heating of the image by the contacting heated member is in addition to heating by a heater, internal to said intermediate transfer member, wherein said heated member supplies at least 70% of the heat for heating the toner of the image on said intermediate transfer member.

14. A method of heating toner of an image on a moving surface of an intermediate transfer member in order to transfer the image to a printing medium of a printing system comprising:

providing a toner image on an intermediate transfer member; and placing a surface of a heated member in contact with said image on said intermediate transfer member, prior to transferring the toner image to a further surface from the intermediate transfer member, wherein heating of the image by the contacting heated member is in addition to heating by a heater, internal to said intermediate transfer member, and including transferring the heated image from the intermediate transfer member wherein heating the toner image to a temperature suitable for transfer to a final substrate uses less than 50% of the energy necessary to heat said toner to said suitable temperature by a heater internal to the intermediate transfer member alone.

15. A system for heating a toner image for printing on a print media comprising:

an intermediate transfer member, adapted to receive an image at a first position and to transfer the received image at a second position; and a heating member contacting said image and said intermediate transfer member and heating the image as said intermediate transfer member passes between said first and second positions, wherein heating of the image by the heating member is in addition to heating by a heater, internal to said intermediate transfer member, wherein the heating member comprises a heated moving belt supported by at least two spaced wheels, wherein a segment of the belt supported and extended between the spaced wheels provides surface contact with the intermediate transfer member.

16. A system according to claim 15 and including means for removing excess carrier liquid from the image prior to transfer of the image to the intermediate transfer member.

17. A system according to claim 15 wherein the heating member further comprises at least one heating unit positioned in at least one of the at least two spaced wheels.

18. A system according to claim 15 wherein the heating member further comprises at least one heating unit positioned in a void covered by the belt.

19. A system according to claim 15 wherein the at least two spaced wheels of the heating member comprise three triangularly-spaced wheels.

* * * * *